US005489196A

United States Patent [19]

Lee

[11] Patent Number: 5,489,196

[45] Date of Patent: Feb. 6, 1996

[54] MANUAL PUMP

[76] Inventor: Tzu-Chi Lee, No. 14, Alley 2, Lane 118, Sec. 2, Ho-Ping E. Rd., Taipei City, Taiwan

[21] Appl. No.: 496,022

[22] Filed: Jun. 28, 1995

[51] Int. Cl.[6] ..... F04B 37/10; F04B 39/14

[52] U.S. Cl. ..... 417/239; 417/442

[58] Field of Search ..... 417/239, 442, 417/568, 571

[56] References Cited

U.S. PATENT DOCUMENTS

| | | | |
|---|---|---|---|
| 4,728,260 | 1/1988 | Ishii | 417/442 |
| 5,071,325 | 12/1991 | Tupper | 417/571 |
| 5,156,538 | 10/1992 | Lee | 417/239 |

*Primary Examiner*—Richard A. Bertsch
*Assistant Examiner*—William Wicker
*Attorney, Agent, or Firm*—Morgan & Finnegan

[57] ABSTRACT

A manual pump includes first, second and third tubular members, and a restraining ring member. The first tubular member has a piston which is mounted movably in the first tubular member. The second tubular member has an upper open end which is fixed sealingly to a lower open end of the first tubular member. The second tubular member further has a first side wall that has first inflow and outflow check valves, and a lower closed end that has second inflow and outflow check valves and a first opening. The third tubular member has a top open end, a bottom constricted end, and a partition. A second opening is formed in a second side wall of the third tubular member. A third opening is formed in the partition. The second side wall has an external thread that is formed near the top open end of the third tubular member. The second tubular member is inserted rotatably into the third tubular member. The restraining ring member has an internal thread that engages the external thread of the third tubular member so that the second tubular member can be prevented from disengaging from the third tubular member but can permit the third tubular member to rotate in the third tubular member.

2 Claims, 5 Drawing Sheets

MANUAL PUMP

BACKGROUND OF THE INVENTION

1. Field of the Invention

This invention relates to a pump, more particularly to a manually operable pump.

2. Description of the Related Art

The improvement of this invention is directed to a conventional manual pump which is disclosed in the applicant's U.S. Pat. No. 5,156,538, issued on Oct. 20, 1992, the disclosure of which is hereby incorporated by reference. The conventional manual pump comprises an elongated tubular member which has an upper closed end and a lower open end with a first opening. The elongated tubular member further has a second opening on its side wall and a piston movable therein. The elongated tubular member is disposed rotatably and engagably in a first tubular member. The first tubular member has first inflow and outflow check valves, second inflow and outflow check valves, and a third opening. When the elongated tubular member is rotated in the first tubular member, the first and second openings of the same can be selectively aligned with the corresponding first inflow or outflow check valve and with the corresponding third opening or second inflow or outflow check valves of the first tubular member. The elongated tubular has a circumferential projection which extends into a circumferential recess that is formed on the inner face of the first tubular member in order to preclude disengagement of the elongated tubular member from the first tubular member. The disadvantage of the conventional manual pump resides in that the manufacture of the mold which is used to form the first tubular member with the check valves and the circumferential recess is difficult to conduct, thereby resulting in a relatively high mold-manufacturing cost.

SUMMARY OF THE INVENTION

It is therefore a main object of this invention to provide a manual pump which can be easily manufactured at a lower cost.

Accordingly, the manual pump of the present invention comprises a first tubular member, a second tubular member, a third tubular member, and a restraining ring member.

The first tubular member has an upper closed end, a lower open end, and a piston extending through and mounted movably in the first tubular member.

The second tubular member has an upper open end which is fixed sealingly to the lower open end of the first tubular member, a lower closed end, and a first side wall which interconnects the upper open end and the lower closed end. The first side wall has a first inflow check valve and a first outflow check valve spaced circumferentially from the first inflow check valve, the lower closed end having second inflow and outflow check valves and a first opening.

The third tubular member has a top open end, a bottom constricted end, a second side wall which interconnects the top open end and the bottom constricted end, and a partition provided adjacent the bottom constricted end. The second side wall has a second opening and the partition has a third opening. The second side wall further has an external thread that is formed near the top open end. The second tubular member is inserted rotatably into the third tubular member with the first and second side walls, and the lower closed end and the partition in contact with one another, respectively, in a water-tight relationship. The second tubular member is rotatable to a first position, where the first outlet and second inlet check valves are aligned respectively with the second and third openings, a second position, where the first inlet and second outlet check valves are respectively aligned with the second and third openings, and a third position, where the first and third openings are aligned with one another.

The restraining ring member has an inner face which is formed with an internal thread that engages the external thread of the third tubular member in such a manner that the second tubular member can be prevented from disengaging from the third tubular member but can permit the third tubular member to rotate therein.

By fastening the restraining ring member to the external thread of the third tubular member, the third tubular member can be precluded from disengaging from the second tubular member. The restraining ring member and the external thread of the third tubular member can be easily formed by molds of a lower manufacturing cost.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
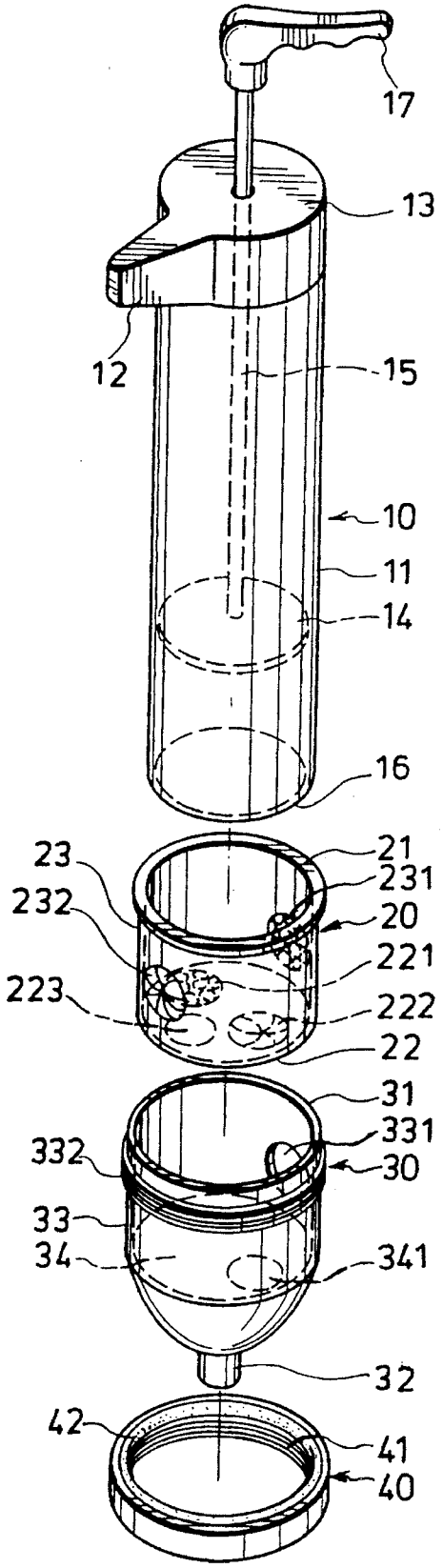
FIG. 1 is a perspective exploded view of a preferred embodiment of a manual pump according to the present invention.
Figure 2:
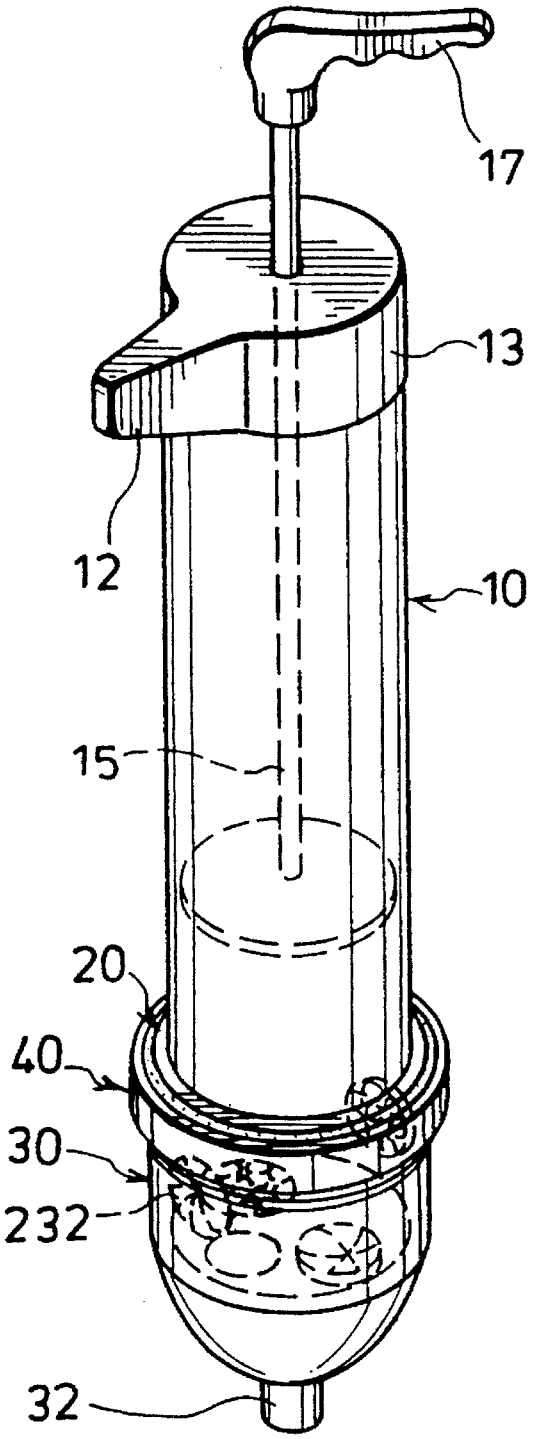
FIG. 2 is a perspective view of the preferred embodiment of the manual pump according to the present invention.

Referring to FIGS. 1 and 2, a preferred embodiment of a manual pump of the present invention is shown to comprise a first tubular member 10, a second tubular member 20, a third tubular member 30, and a restraining ring member 40.

The first tubular member 10 has an upper closed end 13, a lower open end 16, and a wall body 11 which interconnects the upper closed end 13 and the lower open end 16. A piston includes a piston head 14 and a piston rod 15 which has a first end that is centrally connected to the piston head 14 and a second end that extends through the upper closed end 13 and that is connected to a handle 17. The piston head 14 which is generally made of rubber or a flexible material, is mounted hermetically and movably in the wall body 11 of the first tubular member 10. An indicator 12 is integrally formed with the upper closed end 13.

The second tubular member 20 has an upper open end 21, a lower closed end 22, and a first side wall 23 which interconnects the upper open end 21 and the lower closed end 22. The upper open end 21 is fixed sealingly to the lower open end 16 of the first tubular member 10 by means of an adhesive or a high frequency sealing technique. Alternatively, the upper open end 21 of the second tubular member 20 may be molded integrally to the lower open end 16 of the first tubular member 10. The first side wall 23 has a first inflow check valve 231 and a first outflow check valve 232 spaced circumferentially from the first inflow check valve 231. The lower closed end 22 has second inflow and outflow check valves 221, 222 and a first opening 223 which is aligned with the indicator 12.

The third tubular member has a top open end 31, a bottom constricted end 32, a second side wall 33 which interconnects the top open end 31 and the bottom constricted end 32, and a partition 34 provided adjacent the bottom constricted end 32. The second side wall 33 has a second opening 331 and the partition 34 has a third opening 341. The second side wall 33 further has an external thread 332 that is formed near the top open end 31. The second tubular member 20 is inserted rotatably into the third tubular member 30 with the first and second side walls 23 and 33, and the lower closed end 22 and the partition 34 in contact with one another, respectively, in a water-tight relationship, as best illustrated in FIGS. 3 and 4.

The restraining ring member 40 has an inner face which is formed with an internal thread 41 and which has a rubber ring 42 fixed thereto. The internal thread 41 of the restraining ring member 40 engages the external thread 332 of the third tubular member 30 in such a manner that the second tubular member 20 can be prevented from disengaging from the third tubular member 30 but can permit the third tubular member 30 to rotate therein. The rubber ring 42 may engage resiliently the external face of the third tubular member 30 in order to increase the engaging force between the restraining ring member 40 and the third tubular member 30.

Figure 3:
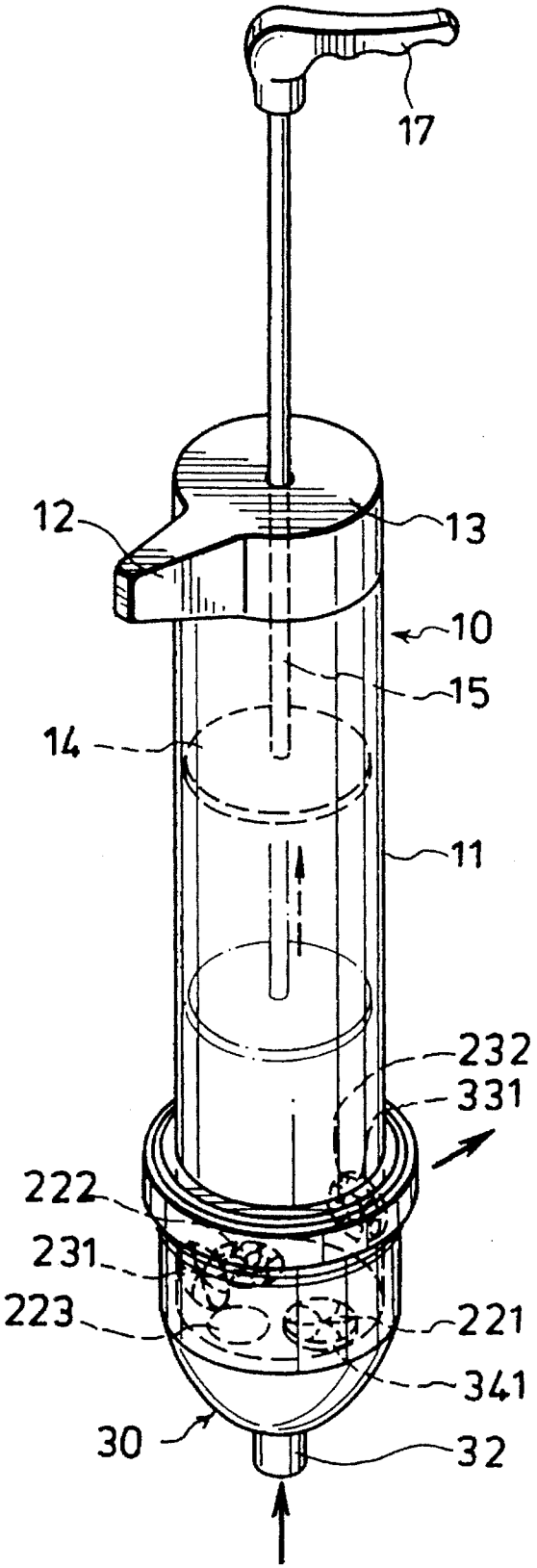
FIG. 3 is a perspective schematic view illustrating the manual pump of the present invention when in a first operative position.

In use, with reference to FIG. 3, the second tubular member 20 may be rotated to a first position, where the first outlet and second inlet check valves 232 and 221 are aligned respectively with the second and third openings 331 and 341. In this position, the first inlet and second outlet check valves 231 and 222 and the first opening 223 are correspondingly sealed by the second side wall 33 and the partition 34. When the piston head 14 is moved upward by pulling the handle 17, a suction force can be created to draw a fluid into the first and second tubular members 20, 30 through the bottom constricted end 32, the third opening 341, and the second inlet check valve 221. When the piston head 14 is moved downward by pushing the handle 17, a compressive force is created to force the fluid to flow out of the first and second tubular members 10, 20 via the first outlet check valve 232 and the second opening 331.

Figure 4:
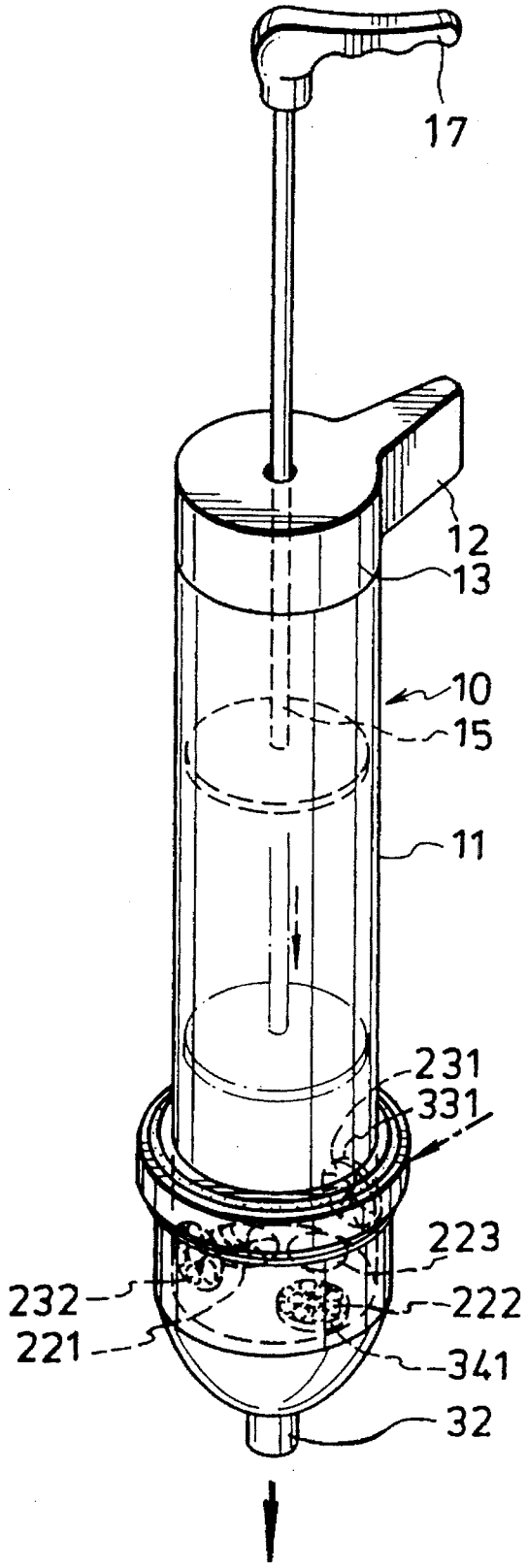
FIG. 4 is a perspective schematic view illustrating the manual pump of the present invention when in a second operative position.

Alternatively, with reference to FIG. 4, the second tubular member 20 may be rotated to a second position, where the first inlet and second outlet check valves 231 and 222 are respectively aligned with the second and third openings 331 and 341. In this position, the first outlet and second inlet check valves 232 and 221 and the first opening 223 are correspondingly sealed by the second side wall 33 and the partition 34. When the piston head 14 is moved upward by pulling the handle 17, a suction force can be created to draw a fluid into the first and second tubular members 20, 30 through the second opening 331 and the first inlet check valve 231. When the piston head 14 is moved downward by pushing the handle 17, a compressive force is created to force the fluid to flow out of the first and second tubular members 10, 20 via the second outlet check valve 222, the third opening 341, and the bottom constricted end 32.

Figure 5:
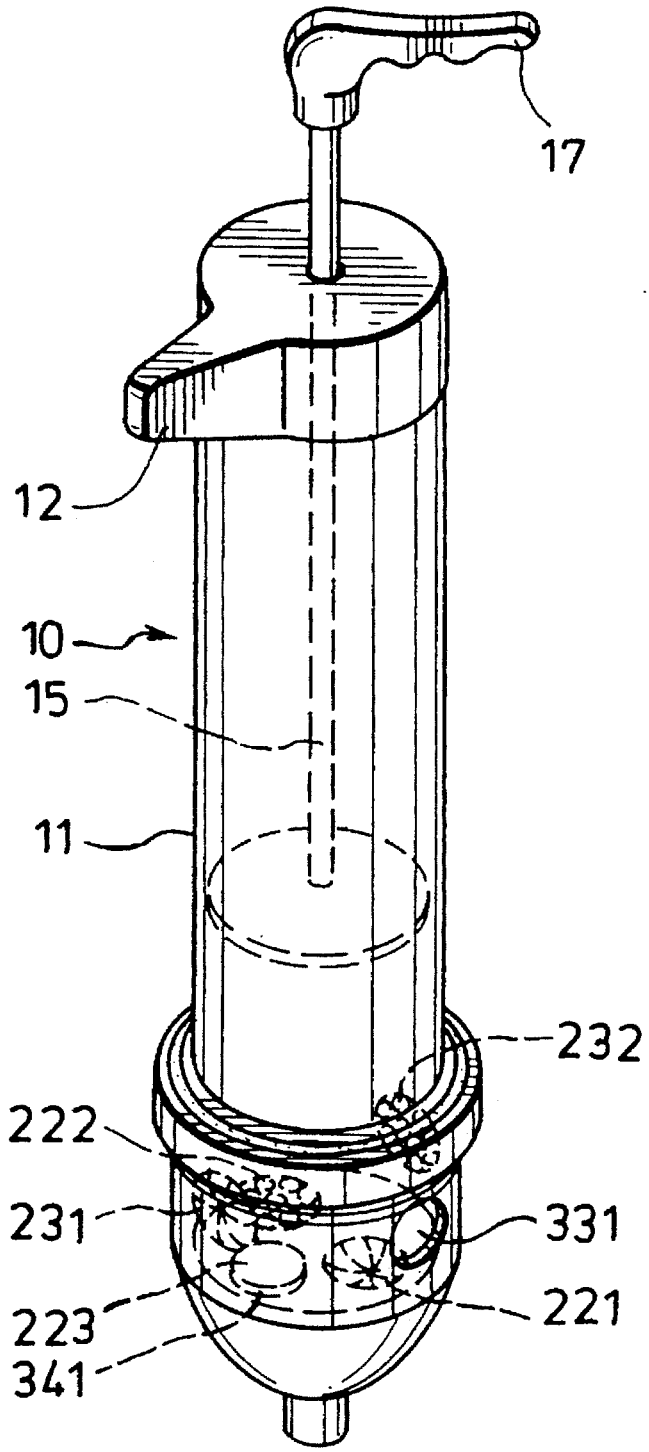
FIG. 5 is a perspective schematic view illustrating the manual pump of the present invention when in a third operative position.

With reference to FIG. 5, the second tubular member 20 may be rotated to a third position, where the first and third openings 223 and 341 are aligned with one another. In this position, all the check valves and the second opening 331 are correspondingly sealed. A suction force and a compressive force can be created due to the upward and downward movement of the piston head 14 in the first tubular member 10. Thus, a fluid can be directly drawn into and forced out of the first and second tubular members 10 and 20.

The advantages of the manual pump of the present invention are as follows:

(1) By fastening the restraining ring member 40 to the external thread 332 of the third tubular member 30, the third tubular member 30 can be precluded from disengaging from the second tubular member 20. The restraining ring member 40 and the external thread 332 of the third tubular member 30 can be easily formed by molds of a relatively low manufacturing cost. Therefore, the manual pump can be easily manufactured at a lower cost.

(2) Since the check valves are all provided in the second tubular member 20, which is fixed directly to the first tubular member 10 in which the piston is operated, the suction and compressive forces applied to a working fluid can be enhanced.

With this invention thus explained, it is apparent that numerous modifications and variations can be made without departing from the scope and spirit of this invention. It is therefore intended that this invention be limited only as indicated in the appended claims.

I claim:

1. A manual pump comprising:

a first tubular member having an upper closed end, a lower open end, and a piston extending through and mounted movably in said first tubular member;

a second tubular member having an upper open end which is fixed sealingly to said lower open end of said first tubular member, a lower closed end, and a first side wall which interconnects said upper open end and said lower closed end, said first side wall having a first inflow check valve and a first outflow check valve spaced circumferentially from said first inflow check valve, said lower closed end having second inflow and outflow check valves and a first opening;

a third tubular member having a top open end, a bottom constricted end, a second side wall which interconnects said top open end and said bottom constricted end, and a partition provided adjacent said bottom constricted end, said second side wall having a second opening, and said partition having a third opening, said second side wall further having an external thread that is formed near said top open end, said second tubular member being inserted rotatably into said third tubular member with said first and second side walls, and said lower closed end and said partition in contact with one another, respectively, in a water-tight relationship, said second tubular member being rotatable to a first position, where said first outlet and second inlet check valves are aligned respectively with said second and third openings, a second position, where said first inlet and second outlet check valves are respectively aligned with said second and third openings, and a third position, where said first and third openings are aligned with one another; and a restraining ring member having an inner face which is formed with an internal thread that engages said external thread of said third tubular member in such a manner that said second tubular member can be prevented from disengaging from said third tubular member but can permit said third tubular member to rotate therein.

2. A manual pump as claimed in claim 1, wherein said inner face of said restraining ring member further has a rubber ring fixed thereto.

* * * * *